US008013776B2

(12) United States Patent
Child

(10) Patent No.: US 8,013,776 B2
(45) Date of Patent: Sep. 6, 2011

(54) RADAR CAMOUFLAGE FABRIC

(75) Inventor: Andrew D. Child, Moore, SC (US)

(73) Assignee: Milliken & Company, Spartenburg, SC (US)

( * ) Notice: Subject to any disclaimer, the term of this patent is extended or adjusted under 35 U.S.C. 154(b) by 1156 days.

(21) Appl. No.: 11/800,601

(22) Filed: May 7, 2007

(65) Prior Publication Data

US 2011/0095931 A1 Apr. 28, 2011

(51) Int. Cl.
*H01Q 17/00* (2006.01)

(52) U.S. Cl. ..... 342/1; 342/3; 342/4

(58) Field of Classification Search ..... 342/1–4; 428/17

See application file for complete search history.

(56) References Cited

U.S. PATENT DOCUMENTS

| | | | | |
|---|---|---|---|---|
| 3,349,396 | A * | 10/1967 | Reed | 342/3 |
| 3,967,026 | A | 6/1976 | Dalblom | 428/195.1 |
| 4,034,375 | A * | 7/1977 | Wallin | 342/3 |
| 4,323,605 | A | 4/1982 | Rush | 428/17 |
| 4,606,966 | A * | 8/1986 | Karlsson | 428/196 |
| 4,803,096 | A | 2/1989 | Kuhn et al. | 427/121 |
| 4,877,646 | A | 10/1989 | Kuhn et al. | 427/121 |
| 4,975,317 | A | 12/1990 | Kuhn et al. | 442/115 |
| 4,981,718 | A | 1/1991 | Kuhn et al. | 427/121 |
| 5,030,508 | A | 7/1991 | Kuhn et al. | 442/115 |
| 5,108,829 | A | 4/1992 | Kuhn et al. | 442/115 |
| 5,312,678 | A * | 5/1994 | McCullough et al. | 442/189 |
| 5,532,052 | A * | 7/1996 | Eng et al. | 442/314 |
| 5,716,893 | A | 2/1998 | Child | 442/63 |
| 5,833,884 | A | 11/1998 | Child | 252/500 |
| 6,001,749 | A | 12/1999 | Child et al. | 442/71 |
| 2010/0093238 | A1 * | 4/2010 | Schwarz | 442/116 |
| 2011/0095931 | A1 * | 4/2011 | Child | 342/3 |

FOREIGN PATENT DOCUMENTS

| | | | |
|---|---|---|---|
| DE | 38 10 121 | | 10/1989 |
| DE | 289 186 | | 4/1991 |
| EP | 0 468 173 | | 1/1992 |
| EP | 1 703 247 | | 9/2006 |
| JP | 03007897 | A * | 1/1991 |
| KR | 2006034081 | A * | 4/2006 |
| WO | WO 2007069803 | A1 * | 6/2007 |
| WO | WO 2009017520 | A2 * | 2/2009 |

OTHER PUBLICATIONS

Dehmollaian, M.; Sarabandi, K.; , "Polarization discrimination for improving foliage-camouflaged target detection," Geoscience and Remote Sensing Symposium, 2005. IGARSS '05. Proceedings. 2005 IEEE International , vol. 7, No., pp. 4604-4606, Jul. 25-29, 2005.*

Military Specification MIL-PRF-53134, Performance Specification, Ultralightweight Camouflage Net System, Apr. 26, 2006.

* cited by examiner

*Primary Examiner* — John Sotomayor
(74) *Attorney, Agent, or Firm* — Cheryl J. Brickey

(57) ABSTRACT

A radar camouflage fabric comprising a base fabric layer and a conductive garnish fabric layer attached to the base fabric layer. The conductive garnish fabric layer comprises a conductive polymer coating and a plurality of holes. The radar camouflage fabric has an average microwave transmission of less than 50% at 6-8 GHz and the conductive garnish fabric layer has an electrical surface resistance less than the electrical surface resistance of the base fabric layer.

17 Claims, 1 Drawing Sheet

RADAR CAMOUFLAGE FABRIC

TECHNICAL FIELD

The present invention generally relates to camouflage fabric. More particularly, the invention relates to multi-spectral camouflage netting that exhibits radar absorbing properties.

BACKGROUND

In the military circumstances of today, there is a continuing need for camouflage which has several rather specific requirements, depending upon the use to which it will be put. The older and more obvious requirements are that the camouflage must be capable of presenting a visual appearance similar to the surroundings, i.e., it must look like snow when it is designed for use in an arctic environment, or it must look like soil or vegetation or some combination thereof, when it is to be used to conceal an object in a woodland environment. The camouflage fabric must also be flexible so that it can be draped over an object, with or without a support framework, and it must be light enough in weight so that it can be easily handled by one or a few individuals and placed in the desired location.

As the art of making camouflage has improved, so have the techniques of detecting deployed camouflage. Thus, it is now desirable to provide camouflage which has infrared reflectance and thermal emission characteristics similar to the environment, in addition to the visual characteristics. Also, for many applications, the camouflage fabric must present a reflected radar signal similar to the environment to avoid detection by radar. If the camouflage fabric has all of these characteristics, it is possible to avoid detection by infrared, thermal imaging, optical observation devices, and radar.

In the prior art efforts to provide camouflage meeting these, and other requirements, it has become customary to provide a multi-layered camouflage netting system, typically a base layer and an outer layer. The outer layer, or garnish, is typically coated or printed with at least one pigmented coating layer, the coating layer or layers being designed to provide the desired optical characteristics (visual, infrared and thermal). The garnish layer may be incised or cut, stretched and then attached to the base layer to produce a three-dimensional leaf structure as described in U.S. Pat. Nos. 4,323,605 and 3,069,796.

In order to provide adequate radar concealment, the total transmission of the net system to radar waves must be lower than 50%. Traditionally, a radar absorbing material such as carbon or graphite is coated onto one or both layers of fabric. In order to achieve the necessary system conductivity to be effective at blocking transmission of radar waves, both layers of fabric often must be coated with carbon-containing coating. While camouflage material of both radar defeating and radar transparent types has been successfully produced with this combination of materials, certain shortcomings have become apparent. To have the required amount of conductivity using carbon or graphite, thicker coatings must often be applied adding considerably to the total weight of the camouflage material. Additionally, highly loaded coatings containing carbon black have been shown to have limited durability to abrasion and reduced strength of the material.

Concealment properties of radar camouflage may be improved by providing radar absorbing and reflecting material that has a vertical component. Rush in U.S. Pat. No. 4,323,605, provided a three-dimension garnish layer with a percentage of the garnish layer having a radar active coating oriented in the vertical plane demonstrating an improved radar signature degradation over single plane radar active layers.

There remains a need to provide a camouflage netting system with radar absorbing material on the garnish layer, where the garnish layer is cut to reveal voids and provide a three-dimensional radar active surface that has improved radar camouflage and visual camouflage characteristics as well as being light weight and durable.

SUMMARY

The present invention provides advantages and/or alternatives over the prior art by providing a radar camouflage fabric comprising a base fabric layer and a conductive garnish fabric layer attached to the base fabric layer. The conductive garnish fabric layer comprises a conductive polymer coating and a plurality of holes. The radar camouflage fabric has an average microwave transmission of less than 50% at 6-8 GHz and the conductive garnish fabric layer has an electrical surface resistance less than the electrical surface resistance of the base fabric layer.

BRIEF DESCRIPTION OF THE DRAWINGS

The present invention will now be described by way of example only, with reference to the accompanying drawings which constitute a part of the specification herein and in which.

DETAILED DESCRIPTION

Figure 1:
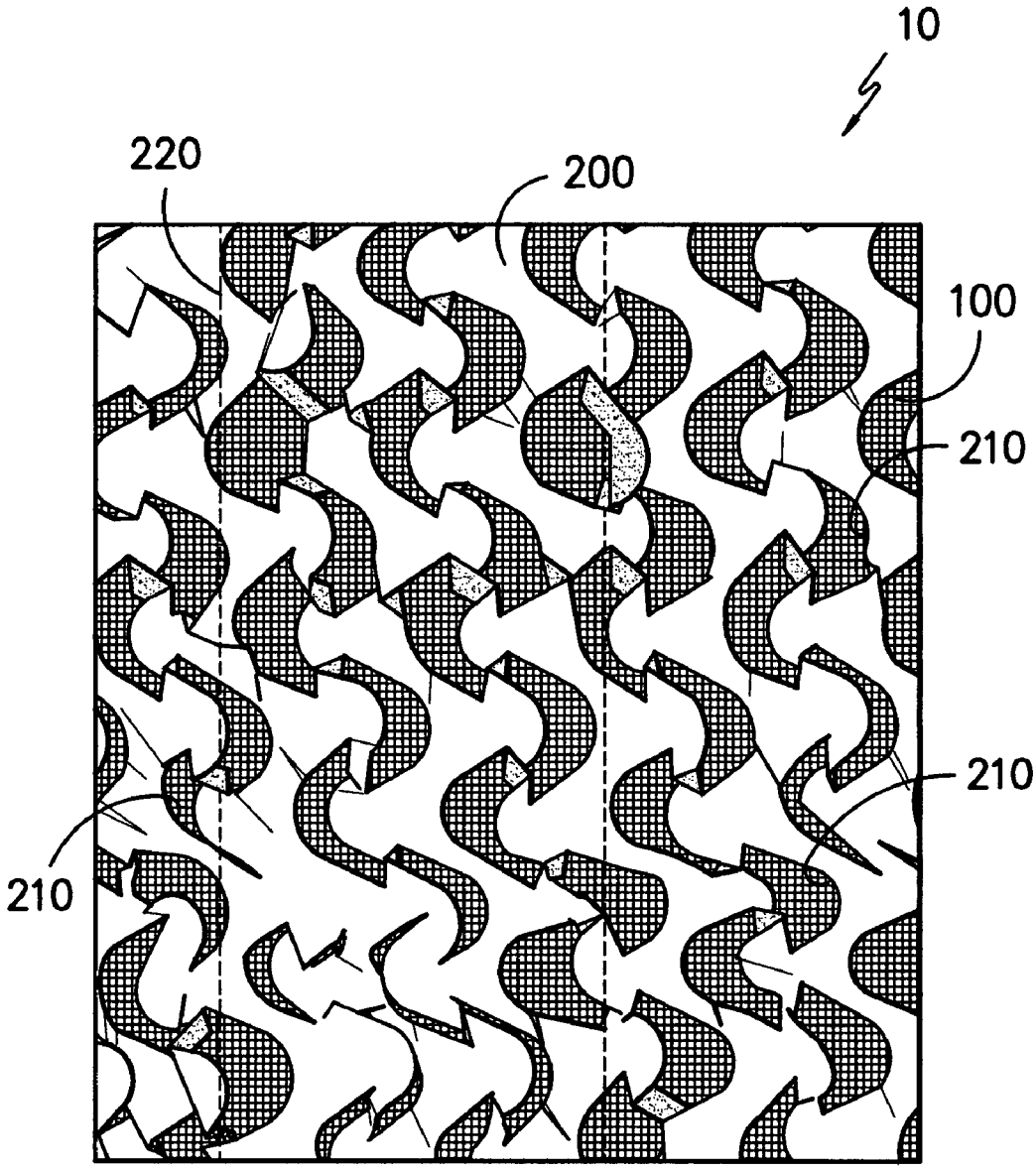
FIG. 1 shows one embodiment of the radar camouflage fabric.

Without limiting the scope of the invention, the preferred embodiments and features are hereinafter set forth. Unless otherwise indicated, all parts and percentages are quoted by weight and at ambient conditions (i.e. one atmosphere of absolute pressure and 25° C.). All of the United States patents cited in this specification are incorporated by reference.

Referring now to FIG. 1, there is shown one embodiment of the radar camouflage fabric 10. The radar camouflage fabric 10 contains two layers: a base textile layer 100 and a conductive garnish fabric layer 200 attached to the base textile layer 100. The radar camouflage fabric 10 has an average microwave transmission of less than 50% at 6-8 GHz. It has been found that this range produces a radar camouflage fabric 10 that provides adequate concealment from radar detection means. The conductive garnish fabric layer 200 has an electrical surface resistance less than that of the base fabric layer 100.

The base textile layer 100 and the conductive garnish fabric layer 200 may be of any stitch construction suitable to the end use, including by not limited to woven, knitted, non-woven, and tufted textiles, or the like. Woven textiles can include, but are not limited to, plain, satin, twill, basket-weave, poplin, and crepe weave textiles. Jacquard woven structures may be useful for creating more complex electrical patterns. Knit textiles can include, but are not limited to, circular knit, reverse plaited circular knit, weft insert knit, double knit, single jersey knit, two-end fleece knit, three-end fleece knit, terry knit or double loop knit, warp knit, and warp knit with or without a microdenier face. The fabric layers 100, 200 may be flat or exhibit a pile. Nonwoven fabrics or substrates can be formed from many processes such as, meltblowing processes, spunbonding processes, air laying processes, needle punched, and bonded carded web processes. The openness of the fabrics 100, 200 chosen may vary, but is preferably small enough so as not to snag on equipment or objects to be concealed, e.g., parts of fixed or rotary wing aircraft. The openness of the fabrics 100, 200 also should be chosen to permit sufficient passage of air there through providing low wind-resistance of the camouflage constructions in their geographic areas of use.

The fabrics 100, 200 are formed of fibers. As used herein fibers shall include continuous strand of textile fibers, spun or twisted textile fibers, textile filaments, or material in a form suitable for knitting, weaving, or otherwise intertwining to form a textile. The term fiber includes, but is not limited to, monofilament fibers, multifilament fibers, staple fibers, or a combination thereof.

The fibers of the fabrics 100, 200 may be any natural fiber, man-made fiber, or mixtures thereof. Man-made fibers that may be employed include polyethylene, polypropylene, polyesters (polyethylene terephthalate, polybutylene terephthalate, polytrimethylene terephthalate, polylactic acid, and the like, including copolymers thereof), nylons (including nylon 6 and nylon 6,6), regenerated cellulosics (such as rayon or Tencel™), elastomeric materials such as Lycra™, high-performance fibers such as the polyaramids, polyimides, PEI, PBO, PBI, PEEK, liquid-crystalline, thermosetting polymers such as melamine-formaldehyde (Basofil™) or phenol-formaldehyde (Kynol™), basalt, glass, ceramic, cotton, coir, bast fibers, proteinaceous materials such as silk, wool, other animal hairs such as angora, alpaca, or vicuna, and blends thereof. In one embodiment, the fibers are polyester continuous filament fibers. It has been found that polyester continuous filament fibers are able to provide the required strength, stability and other performance requirements at a reasonable manufacturing cost.

The conductive garnish fabric layer 200 has a plurality of holes 210. These holes may be formed from material being completely cut out of the garnish fabric 200 or can be made from cutting flaps in the fabric such that when the garnish fabric 200 is attached to the base fabric 100 these flaps partially or fully open forming holes in the conductive garnish fabric layer 200 to microwave radiation. In one embodiment, cuts (preferably in an array of incisions) are formed in the garnish layer and when the garnish is stretched and attached to the base layer, the flaps form holes in the garnish layer. Preferably, the radar camouflage fabric 10 has microwave transmission in the regions of the holes 210 in the conductive garnish fabric layer 200 greater than 50%, more preferably greater than 75%, more preferably greater than 85%, at 6-8 GHz. In one embodiment, the plurality of holes 210 has an average width of between about 1 and 6 inches. In another embodiment, the plurality of holes 210 covers between about 10% and 50% of the surface area of the radar camouflage fabric 10. Preferably, the garnish layer comprises an irregular array of hole sizes and spacing. The pattern of holes 210 in the conductive garnish fabric layer 200 produces a pattern of microwave transmissions that mimic the surrounding terrain forming the radar camouflage fabric 10.

In one embodiment, the base fabric layer 100 is nonconductive. In this application, "nonconductive" means "radar transparent" which is defined to be a surface resistivity greater than about 100,000 ohms/square. Having a nonconductive base fabric produces a radar camouflage fabric 10 with a high amount of difference in the microwave transmission between the areas of the radar camouflage fabric 10 covered by the garnish 200 and the holes 210 in the garnish fabric layer 200. Having a high contrast of the microwave transmission between the areas of holes 210 versus areas of garnish fabric 200 produces a radar signature that more closely matches background reflection. In another embodiment, the base fabric layer 100 has a surface resistance of between about 500-1000 ohms/square.

One measure of the ability of radar camouflage to match the reflection of the background is the percent standard deviation as described in the military specification MIL-PRF-53134. The finished camouflage material is subjected to radar transmission testing in which an X band waveguide is fitted in the aperture of the admittance tunnel. The transmission data is recorded at 10 GHz as the waveguide is scanned across the material in 0.10 inch increments. A calculation is made to determine the standard deviation of the measurements. The standard is to achieve a standard deviation of 10% to 25%. However, values at the upper end of this range lead to higher performance in terms of matching background reflection. Lower standard deviation values produce radar images that are seen as uniform blocks in the shape of the camouflage netting system.

The standard deviation value can be increased by maximizing the difference in the radar transmission of the garnish layer and the base layer. If this difference is high, the transmission measurement made when the waveguide is over the area with base material only, corresponding to the holes in the garnish layer 210, will be significantly higher than when the waveguide is over the portion of camouflage netting where the garnish and base are present.

In addition to the standard deviation measurement, the military specification MIL-PRF-53134 requires that the total % transmission be below 50%. In order to achieve the high values of standard deviation desired to match background reflection and satisfy the average transmission requirements, the garnish material must be sufficiently conductive to provide the majority of the radar transmission loss properties.

The conductive garnish fabric layer 200 may be attached to the base fabric layer 100 in any known means, including but not limited to adhesive, stitching, and ultrasonic welding. The attachment may be at regular or irregular intervals and may be in a set pattern, such as a plurality of straight lines 220. The conductive garnish fabric layer 200 is attached to the base fabric layer 100 such that at least a portion of the conductive garnish fabric layer 200 is oriented out of the plane of the base fabric layer 100. The resulting non-uniform angles of reflection gives the radar camouflage fabric 10 more of a visual camouflage element and helps the camouflage fabric bend in with the terrain as well as providing additional radar scattering.

The base fabric layer 100 and/or the conductive garnish fabric layer 200 may be printed with a visual camouflage pattern. The camouflage pattern may be formed by any known method including printing or dyeing. For example, the substrate may be dyed black, and the woven sheet may be dyed in various random patterns of green, brown, and black to conform to the colors of a forest terrain in which the camouflage construction is to be employed. Additionally, the pattern formed may be for desert or other terrains.

The conductive garnish fabric layer 200 comprises coating of a conductive polymer. The conductive polymer may be, for example, a polyacetylene, polypyrrole, poly(ethylenedixoythiophene), polythiophene, polyaniline, polyfluorene, poly(3-alkylthiophenes), polynaphthalene, poly(p-phenylene sulfide), and poly(para-phenylene vinylene). The conductive polymer may be coated onto fibers which are then formed into the fabric or may be coated onto the formed fabric. The conductive garnish fabric layer 200 preferably has a surface resistivity of between 50 and 500, more preferably 50 to 350 ohms/square. The conductive garnish fabric layer 200 has an electrical surface resistance less than that of the base fabric layer 100. In one embodiment, the conductive garnish fabric layer 200 has a surface resistance of less than 50% of that of the base fabric layer 100. In another embodiment, the base fabric layer 100 has an average radar transmission of greater than 50% more than the radar transmission of the garnish layer 200 at 6-8 GHz.

Preferably, the conductive polymer comprises polypyrrole. In another embodiment, the conductive polymer comprises polyaniline. The preparation of the polypyrrole and polyaniline and coating onto fibers of the fabric may be found in U.S. Pat. Nos. 4,803,096, 4,877,646, 4,975,317, 4,981,718, and 5,030,508, each of which is incorporated by reference. Preferably, the conductive coating is on the conductive garnish fabric layer 200 in an amount of between 0.02 and 0.10 ounces per square yard. It has been found that with conductive polymers, this add-on weight provides the necessary conductivity of the conductive garnish fabric layer 200.

Conductive polymers of this type are substantially more conductive than carbon-based coatings for textiles and can therefore, provide the required conductivity level for optimal radar performance in a thin, flexible, lightweight coating. In one embodiment, the conductive polymer layer is on the garnish layer 200 only and the base layer 100 is approximately radar transparent. Trying to provide adequate conductivity on a single layer with traditional carbon-based coatings has proven to be problematic and results in thick, stiff, heavy, and brittle coatings. For this reason, it has been customary to provide similar conductivities on both layers of the camouflage netting system when utilizing carbon-based coatings, resulting in inferior radar performance.

Preferably, the polypyrrole is doped with anthraquinone-2-sulfonic acid for environmental stability. Anthraquinone-2-sulfonic acid or its sodium salt has been found to be a superior doping agent when used in the chemical oxidation of a pyrrole compound to produce a conductive textile fabric. Unlike prior art doping agents, anthraquinone-2-sulfonic acid demonstrates optimum performance, measured by conductivity, stability and degree of doping (sulfur count) in the final product, at relatively low concentrations in the aqueous reaction solution. Details about the chemistry and method of doping may be found in U.S. Pat. No. 5,108,829, which is incorporated herein by reference. Optionally, a stability enhancement agent such as dihydroxybenzophenone may be added to improve the stability of the conductive layer. Details about stability enhancement agents, and the methods of use are provided in U.S. Pat. Nos. 5,716,893, and 5,833,844, each of which are incorporated herein by reference.

In one embodiment, the conductive garnish fabric layer 200 is coated with an environmental durability coating. The environmental durability coating is defined to be a coating that provides a barrier on the surface of the conductive polymer to reduce the rate of oxidative and chemical degradation of the fabric conductivity. The coatings are preferably continuous with a low amount of pinholes. Acceptable barrier coatings include aqueous dispersions of polyvinyl chloride, poly(vinylidene chloride), polyurethanes, acrylics, styrene butadiene, and polyolefins. Preferably, the environmental durability coating is poly(vinylidene chloride). In another embodiment, the environmental durability coating is an acrylic latex that contains others additives such as UV inhibitors or absorbers, and flame retardant agents. Preferably, the add-on for the environmental durability coating is about 0.3 to 0.8 ounces per square yard.

Example

A camouflage netting system was constructed with a (1) A base fabric layer of 2.5 ounce per square yard Rachel knit fabric made of polyester continuous filament fibers. The base layer was coated with 0.9 ounces per square yard of an acrylic latex formulation including an antimony oxide flame retardant, a halogen flame retardant, and a green pigment. The base fabric layer was radar transparent, meaning that it had a surface resistance of greater than 100,000 ohms/square.

(2) A conductive garnish fabric layer constructed of 2.2 ounce per square yard tricot knit made of polyester continuous filament fibers that had been coated with anthraquinone-2-sulfonic acid doped polypyrrole to a surface resistance of 200 ohms per square. The conductive garnish was over coated with 0.6 ounces per square yard of an environment durability coating comprising an acyclic latex containing a halogenated flame retardant. The garnish fabric was then printed with a camouflage pattern design to conceal the net system from visual detection in a woodland environment.

The garnish fabric was incised cut and then stretched in the width direction revealing holes in the fabric and providing folds of the garnish fabric that extended out of the plane of the fabric. The stretched garnish fabric was attached to the base fabric by quilting lines approximately 12 inches apart down the length of the fabric.

The combined net system was cut and sewn into the required shapes for camouflaging various vehicles, aircraft, or personnel. The resulting net system displayed less than 50% average microwave transmission in the 6-8 GHz range and was an effective, light weight, and durable screening system for reducing the radar signature of high radar reflecting structures.

While the present invention has been illustrated and described in relation to certain potentially preferred embodiments and practices, it is to be understood that the illustrated and described embodiments and practices are illustrative only and that the present invention is in no event to be limited thereto. Rather, it is fully contemplated that modifications and variations to the present invention will no doubt occur to those of skill in the art upon reading the above description and/or through practice of the invention. It is therefore intended that the present invention shall extend to all such modifications and variations as may incorporate the broad aspects of the present invention within the full spirit and scope of the invention.

What is claimed is:

1. A radar camouflage fabric comprising:

a base fabric layer; and, a conductive garnish fabric layer attached to the base fabric layer by a plurality of stitches in a plurality of straight lines, wherein at least a portion of the conductive garnish fabric layer is oriented out of the plane of the base fabric layer, and wherein the conductive garnish fabric layer comprises a conductive polymer coating and comprises a plurality of holes having an irregular array of hole sizes and spacing formed from an array of incisions, wherein the radar camouflage fabric has an average microwave transmission of less than 50% at 6-8 GHz and the conductive garnish fabric layer has an electrical surface resistance less than the electrical surface resistance of the base fabric layer.

2. The radar camouflage fabric of claim 1, wherein the conductive garnish fabric layer has an electrical surface resistance of less than 50% the electrical surface resistance of the base fabric layer.

3. The radar camouflage fabric of claim 1, wherein the conductive garnish fabric layer has an average microwave transmission that is one-half or less than the average microwave transmission of the base fabric layer at 6-8 GHz.

4. The radar camouflage fabric of claim 1, wherein the base fabric layer is nonconductive.

5. The radar camouflage fabric of claim 1, wherein the base fabric layer has a surface resistance of between about 500-1000 ohms/square.

6. The radar camouflage fabric of claim 1, wherein the radar camouflage fabric has microwave transmission greater than 50% at 6-8 GHz in the plurality of holes in the conductive garnish fabric layer.

7. The radar camouflage fabric of claim 1, wherein the conductive polymer comprises polypyrrole.

8. The radar camouflage fabric of claim 1, wherein the conductive polymer comprises polyaniline.

9. The radar camouflage fabric of claim 1, wherein the conductive garnish fabric layer comprises polypyrrole doped with anthraquinone-2-sulfonic acid.

10. The radar camouflage fabric of claim 1, wherein at least one of the base fabric layer and the conductive garnish fabric layer comprise a visual camouflage pattern.

11. The radar camouflage fabric of claim 1, wherein the conductive garnish fabric layer further comprises an environmental durability coating.

12. The radar camouflage fabric of claim 11, wherein the environmental durability coating comprises acrylic latex.

13. The radar camouflage fabric of claim 1, wherein the plurality of holes have an average diameter of between about 1 and 6 inches.

14. The radar camouflage fabric of claim 1, wherein the plurality of holes cover between 10% and 50% of the surface area of the radar camouflage fabric.

15. The radar camouflage fabric of claim 1, wherein the conductive garnish fabric layer has a surface resistance of between about 50 and 500 ohms/square.

16. The radar camouflage fabric of claim 1, wherein the conductive garnish fabric layer comprises a conductive coating weight of between 0.02 and 0.10 ounces per square yard.

17. The radar camouflage fabric of claim 1, wherein the conductive garnish fabric layer is selected from the group consisting of knit, woven, or nonwoven fabric.

* * * * *